US005775992A

United States Patent [19]

Wood et al.

[11] Patent Number: 5,775,992

[45] Date of Patent: Jul. 7, 1998

[54] METHOD OF PLAYING

[76] Inventors: Michael W. Wood, 11831 Wentling Ave., Suite #C, Baton Rouge, La. 70816; Gary Weingardt, 5416 Gipsy, Las Vegas, Nev. 89107

[21] Appl. No.: 723,047

[22] Filed: Sep. 30, 1996

[51] Int. Cl.[6] ..... A63F 1/00

[52] U.S. Cl. ..... 463/13; 273/292; 273/274

[58] Field of Search ..... 463/13, 12; 273/292, 273/274, 309

[56] References Cited

U.S. PATENT DOCUMENTS

| | | | |
|---|---|---|---|
| 5,294,120 | 3/1994 | Schultz | 463/13 |
| 5,393,067 | 2/1995 | Paulsen et al. | 273/292 |
| 5,577,731 | 11/1996 | Jones | 273/292 |

*Primary Examiner*—Benjamin H. Layno
*Attorney, Agent, or Firm*—John Edward Roethel

[57] ABSTRACT

Five decks of playing cards are shuffled together and used to deal five initial cards to a player. From these five initial cards, the player selects which cards to hold and which to discard. Replacement cards are then provided from the same five decks used to deal the initial five cards hand. A final five card hand is analyzed to determine the card combinations and, if the player has achieved one of the preselected winning combinations, the player receives an award. Because of the unique combination of five decks of playing cards, very high awards can be paid of certain winning combinations, such as five of a kind of the same card such as five Aces of Spades. Each of the five decks consists of a standard fifty-two card deck of cards having an Ace through Deuce of each suit of Spades, Hearts, Diamonds and Clubs resulting in a combined deck of 260 cards. Alternatively, each of the five deck can consist of a standard fifty-three card deck of cards having an Ace through Deuce of each suit of Spades, Hearts, Diamonds and Clubs plus a Joker resulting in a combined deck of 265 cards.

10 Claims, 2 Drawing Sheets

METHOD OF PLAYING

This invention relates to a multi-deck poker game, and more particularly to a multi-deck poker game which is preferably played on an electronic video poker machine and in which five or more decks of cards are shuffled together and used to deal the initial five card hand and the replacement cards for discarded cards.

BACKGROUND OF THE INVENTION

Conventional draw poker is well known and accepted by players as a game in which each player is dealt five initial cards. The object is to achieve the highest ranking poker hand that is possible from the initial five cards dealt to each player. If a player wishes to attempt to improve his starting hand, the player discards one or more of his starting cards and receives replacement cards. the resulting five card hand is the player's final five card and is used to determine the outcome of the game.

Conventional draw poker started as a card room game in which each player played against the other players for a pot. The player with the highest ranking poker hand after the draw of replacement cards won the round of play and the pot.

In the late 1970's, electronic versions of draw poker began to appear in gaming casinos. These electronic versions of draw poker took the form of a one player game played on an electronic video gaming machine. Instead of playing against other players for a combined pot, each player played against the "machine" (the gaming establishment). The method of play mimicked conventional draw poker. The player received five initial cards on the initial "deal" step of the game. The player then held whichever of those initial cards that he liked and discarded the cards he no longer wanted. The player received replacement cards for the cards he discarded in this "draw" step. The resulting five card hand is the player's final hand and the poker hand ranking of this final five card hand determined whether the player was a winner or a loser. The object of conventional video draw poker is to draw to make the highest possible poker hand combination according to a posted set of ranked hands. The higher the poker hand achieved by the player, the greater the player's winnings based on the number of coins wagered by the player.

The typical video draw poker machine deals cards from a single standard 52 card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand. A pay table is established based on the number of coins or tokens wagered by the player and the type of poker hand achieved.

Table 1 shows a typical payout schedule that is used in electronic video draw poker machines.

TABLE 1

| FINAL HAND | 1st Coin | 2nd Coin | 3rd Coin | 4th Coin | 5th Coin |
|---|---|---|---|---|---|
| ROYAL FLUSH | 250 | 500 | 750 | 1000 | 4000 |
| STRATGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |

TABLE 1-continued

| FINAL HAND | 1st Coin | 2nd Coin | 3rd Coin | 4th Coin | 5th Coin |
|---|---|---|---|---|---|
| TWO PAIR | 2 | 4 | 6 | 8 | 10 |
| JACKS OR BETTER | 1 | 2 | 3 | 4 | 5 |

The classic draw poker machine has been modified to provide wild cards as part of the conventional fifty-two card deck e.g. "Deuces Wild" (or other cards such as Sevens have been designated as wild cards). Additionally a fifty-three card deck has been used by inserting a Joker as a wild card, e.g. "Joker's Wild". "Joker's Wild" and "Deuces Wild" draw poker still display to the player a single five card hand and allow the player to discard unwanted cards and receive replacement cards. The pay table is modified to recognize the differing odds for achieving various poker hands when wild cards are involved.

The drawback of these conventional electronic video poker games is that the mathematical odds inherent from the use of a fifty-two card or fifty-three card deck limits the size of the highest award that can be paid for the highest possible poker hand—a Royal Flush. Gaming machine manufacturers and gaming casino operators have been able to increase the award that can be paid for a Royal Flush by paying the highest award for a Royal Flush in sequence. Nevertheless, because the deck of cards has only fifty-two (or fifty-three with a Joker) cards, the highest award that can be paid on a electronic video poker machine is quite small when compared to some of the reel slot jackpots that are available for player's to attempt to win.

Many governmental agencies are now operating wagering games. The mainstays of these wagering games are ball draw lotteries. However, over time players lose interest in conventional ball draw games due to the low frequency of which players win prizes. Some of these agencies have turned to conventional slot machines in an attempt to maintain player interest in wagering. This has been somewhat successful since a slot machine can offer very large awards for very infrequent events or a series of smaller awards on a more frequent event basis depending on the type of player the agency is attempting to attract. However, slot machines do not offer the player the feeling of controlling the outcome of the game that the player is provided with by a video draw poker machine.

U.S. Pat. No. 5,255,915 (Miller) discloses a method in which players are dealt an initial six card hand to begin a round of video poker. Slightly improved prize structures could be offered to players with this method of play. However, this game has not been widely accepted as players continue to desire a five card starting hand with which they are already familiar, but players still want large prize structures to be offered with this starting five card hand.

U.S. Pat. No. 5,024,818 (Weingardt) discloses a video poker game in which a player is dealt an initial five card hand from a first standard fifty-two card deck. The player may also receive an additional sixth and seventh card which are provided from one or two separate fifty-two card decks that have not been intermixed with each other or the first fifty-two card deck. This game allows certain seven card combinations to be made and very large payouts are possible. However, only 2,598,960 combinations of the five starting cards are still possible.

U.S. Pat. No. 5,401,023 (Wood) discloses a game of video poker in which the player is dealt an initial five card hand from a single standard fifty-two card deck of playing cards . The player then decides which cards to hold and which cards to discard. Based on the player's selection of which cards to hold and which cards to discard, the pay table is then modified with reference to the degree of risk that the player has chosen. The corresponding pay table defined in relation to the risk/reward selected by the player is limited to the Expected Value of the best way to play the hand that was initially dealt to the player. Although higher payouts can be achieved than occur in conventional video draw poker, very high awards are still not possible since only one fifty-two card deck is being shuffled and used to deal cards to the player.

One common feature in video draw poker that is used to maintain a player's interest in wagering is to offer a player the opportunity to double any winnings he may have accomplished. One conventional "double down" feature provides a single card designated the "dealer's" card and another single card designated the "player's" card. If the player's card beats the dealer's card, then the player's winnings are doubled; if not, then the player's loses his winnings. Other variations of this same theme involve the player guessing whether his single card will be higher or lower than the dealer's single card. Stiff other variations involve suit matching schemes. These "double down" features have not proven to be successful at holding player interest in wagering because these features require the player to risk a win amount that the player has obtained.

Still another special feature that has been used to attempt to maintain player interest in wagering is offering increased awards for card combinations that are in an ordered permutation, such as the sequential Royal Flush referred to above. Video draw poker machines have been configured to pay premium awards for a sequential Royal Flush in either ascending order, descending order or either ascending or descending order when read from right-to-left across the video display screen. But no ordering of cards in special permutations can be more than 120 times as difficult to achieve as a non-ordered hand of the same cards. Thus, the very large awards desired by the players are still not possible with this special order hand feature since there is still a relatively small number of initial five card hand combinations that can be achieved using a single conventional fifty-two card deck of playing cards.

It is an object of the present invention to provide a poker-type card game which has the ability to award very high payouts on the order of those available on reel slot machines.

It is a feature of the present invention to utilize five decks of playing cards, all shuffled together, from which are dealt the five initial cards and any replacement cards that are used by the player to create a five card poker hand.

It is an advantage of the present invention that new and unique winning card combinations are capable of being achieved from a pool of five decks of cards all shuffled together so that very high payouts can be paid to the players.

Other objects, features and advantages of the present invention will become apparent from a consideration of the following detailed description.

SUMMARY OF THE INVENTION

Five decks of playing cards are shuffled together and used to deal five initial cards to a player. From these five initial cards, the player selects which cards to hold and which to discard. Replacement cards are then provided from the same five decks used to deal the initial five card hand. A final five card hand is analyzed to determine the card combinations and, if the player has achieved one of the preselected winning combinations, the player receives an award. Because of the unique combination of five decks of playing cards, very high awards can be paid of certain winning combinations, such as five of a kind of the same suit such as five Aces of Spades.

Each of the five decks consists of a standard fifty-two card deck of cards having an Ace through Deuce of each suit of Spades, Hearts, Diamonds and Clubs resulting in a combined deck of 260 cards. Alternatively, each of the five decks can consist of a standard fifty-three card deck of cards having an Ace through Deuce of each suit of Spades, Hearts, Diamonds and Clubs plus a Joker resulting in a combined deck of 265 cards.

DETAILED DESCRIPTION OF THE PREFERRED EMBODIMENTS

The method of present invention utilizes five decks of cards all shuffled together. This forms a pool of 260 playing cards from which are dealt the cards used in the method of play of the present invention. Each of the five decks consists of a standard fifty-two card deck of cards having an Ace through Deuce of each suit of Spades, Hearts, Diamonds and Clubs resulting in a combined deck of 260 cards.

A player receives an initial five card hand dealt from the combined 260 card deck. The player then selects which, if any, of the initial five cards the player wishes to discard. Any cards that are discarded are replaced by replacement cards from the original combined deck of 260 cards. The player then has a final five card hand.

The final five card hand is analyzed to determine what card combination the player has achieved. Any suitable card combinations can be preselected as winning card combinations. In the preferred embodiment of the present invention, the poker hand ranking of the final five card hand is used along with other card combinations that could not be achieved using a single conventional deck of fifty-two playing cards.

Any suitable card combinations can be preselected as the winning card combinations. A player who achieves a winning card combination is provided with an award.

In the preferred embodiment of the present invention, the winning card combinations are selected based on the mathematical probability of achieving certain card combinations. The highest awards are provided for the card combinations that are most difficult to achieve.

Figure 1:
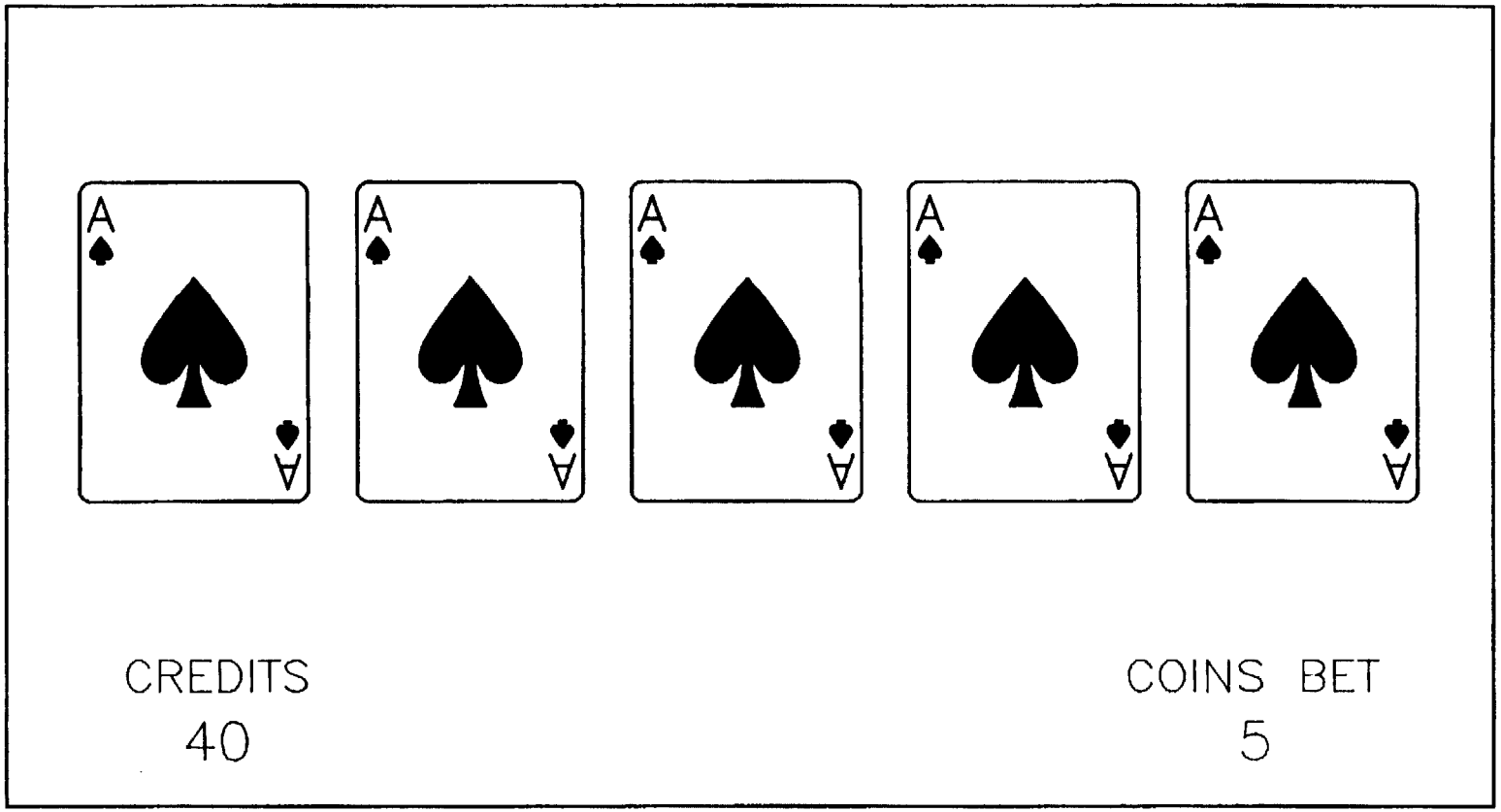
FIG. 1 shows atypical screen display of one type of winning hand combination used in the method of the present invention.

In the preferred embodiment of the present invention, the highest award is provided for achieving all five of the same card, e.g. five Aces of Spades. This winning hand card combination is shown in FIG. 1. Lesser awards are provided for card combinations that are easier to achieve.

The method of the present invention can be adapted to a casino setting in which players make wagers on the outcome of the game and awards are made to the player based on the amount of money wagered by the player to play the game. In the casino version of the present invention, five decks of cards are all shuffled together. Each of the five decks consists of a standard fifty-two card deck of cards having an Ace through Deuce of each suit of Spades, Hearts, Diamonds and Clubs resulting in a combined deck of 260 cards.

A player makes a wager to be eligible to participate in the game and the player receives an initial five card hand dealt from the combined 260 card deck. The player then selects which, if any, of the initial five cards the player wishes to discard. Any cards that are discarded are replaced by replacement cards from the original combined deck of 260 cards. The player then has a final five card hand.

The final five card hand is analyzed to determine what card combination the player has achieved. If the player has achieved a winning card combination, the player is awarded an amount based on the amount of the player's wager.

In the preferred embodiment of the present invention, the highest amount of money is awarded for achieving all five of the same card, e.g. five Aces of Spades. Lesser awards are provided for card combinations that are easier to achieve.

The method of the present invention can be played as a live casino table game in which the five decks of cards are all shuffled together and dealt to the player, either by hand of from a dealing shoe. Alternatively, the method of the present invention can be practiced on an electronic video gaming machine in which the five decks of cards are electronically shuffled and the initial five card hand and any replacement cards are displayed to the player on a video screen. A typical screen display is shown in FIG. 1.

A pay table is also shown on the gaming machine so that the player knows which are the preselected winning card combinations. Table 2 shows a suitable pay table that can be used with a combined 260 card deck. The term "and a flush" means that all five cards in the final hand are in the same suit. For example, the highest payout paid to the player is for a five coin wager with a final hand combination of 5 Aces, 5 Kings, 5 Queens or 5 Jacks all of the same suit, such as 5 Aces of Spades. If the player were to achieve a final hand of 5 Aces, but not all of the same suit, the player would simply be paid for achieving 5 Of A Kind.

TABLE 2

| FINAL HAND COMBINATION | 1ST COIN | 2ND COIN | 3RD COIN | 4TH COIN | 5TH COIN |
|---|---|---|---|---|---|
| 5 JACKS THRU ACES AND A FLUSH | 800000 | 1600000 | 2400000 | 3200000 | 4000000 |
| 5 DEUCES THRU TENS AND A FLUSH | 8000 | 16000 | 24000 | 32000 | 40000 |
| 4 OF A KIND AND A FLUSH | 960 | 1920 | 2880 | 3840 | 4800 |
| ROYAL FLUSH | 800 | 1600 | 2400 | 3200 | 4000 |
| STRAIGHT FLUSH | 100 | 200 | 300 | 400 | 500 |
| 5 OF A KIND | 40 | 80 | 120 | 160 | 200 |
| FULL HOUSE AND A FLUSH | 25 | 50 | 75 | 100 | 125 |
| 4 OF A KIND | 7 | 14 | 21 | 28 | 35 |
| FULL HOUSE | 3 | 6 | 9 | 12 | 15 |
| FLUSH | 3 | 6 | 9 | 12 | 15 |
| STRAIGHT | 3 | 6 | 9 | 12 | 15 |
| 3 OF A KIND AND A FLUSH | 3 | 6 | 9 | 12 | 15 |
| 2 PAIRS AND A FLUSH | 3 | 6 | 9 | 12 | 15 |
| JACKS OF BETTER AND A FLUSH | 3 | 6 | 9 | 12 | 15 |
| 3 OF A KIND | 2 | 4 | 6 | 8 | 10 |
| 2 PAIRS | 2 | 4 | 6 | 8 | 10 |
| PAIR OF JACKS THRU ACES | 1 | 2 | 3 | 4 | 5 |

Figure 2:
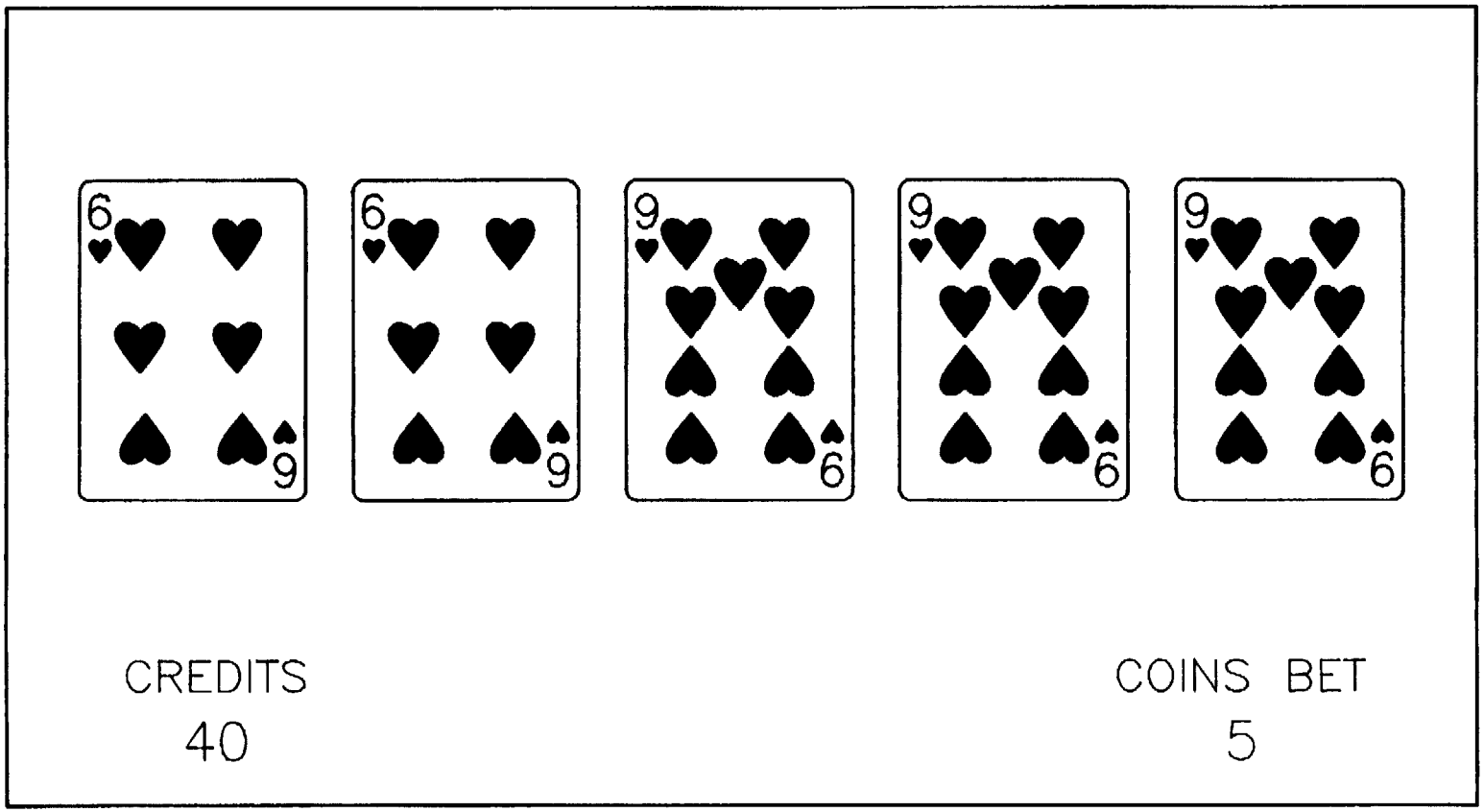
FIG. 2 shows another screen display of another type of winning hand combination in the method of the present invention.

FIG. 2 shows the card combination constituting a Full House and a Flush. In this example, the "Full House" is two Sixes and three Nines. The "and a Flush" is that all cards are of the same suit, namely Hearts.

Another version of the present invention adds one or more Jokers to be used as wild cards to the combined five card deck. In the preferred embodiment of the present invention, one Joker is added for each conventional deck so that a total of five Jokers are added resulting in a combined deck of 265 cards. The addition of Jokers changes the mathematical probability of achieving certain card combinations so the pay table must be adjusted accordingly. The pay table shown in Table 2 would be modified to account of the mathematical probabilities that change due to the addition of one or more Jokers.

While the invention has been illustrated with respect to several specific embodiments thereof these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game comprising:

a) forming a pool, of playing cards consisting essentially of five identical decks of playing cards all shuffled together, each deck of playing cards consisting essentially of a standard deck of fifty-two playing cards;

b) dealing a five card hand from the pool of playing cards;

c) selecting which, if any, of the cards from the five card hand to discard;

d) creating a final five card hand by replacing each discarded card with a replacement card from the pool of playing cards; and e) comparing the final five card hand to one or more preselected winning hand combinations to determine if a winning hand has been achieved whereby at least one of the preselected winning hand combinations includes a hand of five cards, each card having identical suit and rank.

2. The method of claim 1 further comprising:

a) making a wager to participate in the card game; and b) providing an award based on the amount of the wager if the final five card hand is a winning hand.

3. The method of claim 2 in which the award is determined by the following pay-table:

| FINAL HAND COMBINATION | 1ST COIN | 2ND COIN | 3RD COIN | 4TH COIN | 5TH COIN |
|---|---|---|---|---|---|
| 5 JACKS THRU ACES AND A FLUSH | 800000 | 1600000 | 2400000 | 3200000 | 4000000 |
| 5 DEUCES THRU TENS AND A FLUSH | 8000 | 16000 | 24000 | 32000 | 40000 |
| 4 OF A KIND AND A FLUSH | 960 | 1920 | 2880 | 3840 | 4800 |
| ROYAL FLUSH | 800 | 1600 | 2400 | 3200 | 4000 |
| STRAIGHT FLUSH | 100 | 200 | 300 | 400 | 500 |
| 5 OF A KIND | 40 | 80 | 120 | 160 | 200 |
| FULL HOUSE AND A FLUSH | 25 | 50 | 75 | 100 | 125 |
| 4 OF A KIND | 7 | 14 | 21 | 28 | 35 |
| FULL HOUSE | 3 | 6 | 9 | 12 | 15 |
| FLUSH | 3 | 6 | 9 | 12 | 15 |
| STRAIGHT | 3 | 6 | 9 | 12 | 15 |
| 3 OF A KIND AND A FLUSH | 3 | 6 | 9 | 12 | 15 |
| 2 PAIRS AND A FLUSH | 3 | 6 | 9 | 12 | 15 |
| JACKS OF BETTER AND A FLUSH | 3 | 6 | 9 | 12 | 15 |
| 3 OF A KIND | 2 | 4 | 6 | 8 | 10 |
| 2 PAIRS | 2 | 4 | 6 | 8 | 10 |
| PAIR OF JACKS THRU ACES | 1 | 2 | 3 | 4 | 5 |

4. A method of playing a card game comprising:

a) forming a pool of playing cards consisting essentially of five identical decks of playing cards all shuffled together, each deck of playing cards consisting essentially of a fifty-three card deck comprising a standard deck of fifty-two playing cards and a Joker;

b) dealing a five card hand from the pool of playing cards;

c) selecting which, if any, of the cards from the five card hand to discard;

d) creating a final five card hand by replacing each discarded card with a replacement card from the pool of playing cards; and e) comparing the final five card hand to one or more preselected winning hand combinations to determine if a winning hand has been achieved whereby at least one of the preselected winning hand combinations includes a hand of five cards, each card having identical suit and rank.

5. The method of claim 4 further comprising:

a) making a wager to participate in the card game; and b) providing an award based on the amount of the wager if the final five card hand is a winning hand.

6. A method of playing a card game on an electronic video gaming machine comprising:

a) forming a pool of playing cards consisting essentially of five identical decks of playing cards all electronically shuffled together, each deck of playing cards consisting essentially of a standard deck of fifty-two playing cards;

b) displaying on a video screen a five card hand from the pool of playing cards;

c) selecting which, if any, of the cards from the five card hand to discard;

d) creating a final five card hand by displaying a replacement card from the pool of playing cards for any discarded card; and e) comparing the final five card hand to one or more preselected winning hand combinations to determine if a winning hand has been achieved whereby at least one of the preselected winning hand combinations includes a hand of five cards, each card having identical suit and rank.

7. The method of claim 6 further comprising:

a) making a wager to participate in the card game; and b) providing an award based on the amount of the wager if the final five card hand is a winning hand.

8. The method of claim 7 in which the award is determined by the following pay table:

| FINAL HAND COMBINATION | 1ST COIN | 2ND COIN | 3RD COIN | 4TH COIN | 5TH COIN |
|---|---|---|---|---|---|
| 5 JACKS THRU ACES AND A FLUSH | 800000 | 1600000 | 2400000 | 3200000 | 4000000 |
| 5 DEUCES THRU TENS AND A FLUSH | 8000 | 16000 | 24000 | 32000 | 40000 |
| 4 OF A KIND AND A FLUSH | 960 | 1920 | 2880 | 3840 | 4800 |
| ROYAL FLUSH | 800 | 1600 | 2400 | 3200 | 4000 |
| STRAIGHT FLUSH | 100 | 200 | 300 | 400 | 500 |
| 5 OF A KIND | 40 | 80 | 120 | 160 | 200 |
| FULL HOUSE AND A FLUSH | 25 | 50 | 75 | 100 | 125 |

-continued

| FINAL HAND COMBINATION | 1ST COIN | 2ND COIN | 3RD COIN | 4TH COIN | 5TH COIN |
|---|---|---|---|---|---|
| 4 OF A KIND | 7 | 14 | 21 | 28 | 35 |
| FULL HOUSE | 3 | 6 | 9 | 12 | 15 |
| FLUSH | 3 | 6 | 9 | 12 | 15 |
| STRAIGHT | 3 | 6 | 9 | 12 | 15 |
| 3 OF A KIND AND A FLUSH | 3 | 6 | 9 | 12 | 15 |
| 2 PAIRS AND A FLUSH | 3 | 6 | 9 | 12 | 15 |
| JACKS OF BETTER AND A FLUSH | 3 | 6 | 9 | 12 | 15 |
| 3 OF A KIND | 2 | 4 | 6 | 8 | 10 |
| 2 PAIRS | 2 | 4 | 6 | 8 | 10 |
| PAIR OF JACKS THRU ACES | 1 | 2 | 3 | 4 | 5 |

9. A method of playing a card game on an electronic video gaming machine comprising;

a) forming a pool of playing cards consisting essentially of five identical decks of playing cards all electronically shuffled together, each deck of playing cards consisting essentially of a fifty-three card deck comprising a standard deck of fifty-two playing cards and a Joker;

b) displaying on a video screen a five card hand from the pool of playing cards;

c) selecting which, if any, of the cards from the five card hand to discard;

d) creating a final five card hand by displaying a replacement card from the pool of playing cards for any discarded card; and e) comparing the final five card hand to one or more preselected winning hand combinations to determine if a winning hand has been achieved whereby at least one of the preselected winning hand combinations includes a hand of five cards, each card having identical suit and rank.

10. The method of claim 9 further comprising:

a) making a wager to participate in the card game; and b) providing an award based on the amount of the wager if the final five card hand is a winning hand.

* * * * *